United States Patent [19]

Fredericksen et al.

[11] Patent Number: 4,934,072

[45] Date of Patent: Jun. 19, 1990

[54] FLUID DYNAMIC SHOE

[75] Inventors: Raymond M. Fredericksen, Okemos; Daniel T. Barry, Ann Arbor, both of Mich.; Daniel E. Norton, Clackamas, Oreg.

[73] Assignee: Wolverine World Wide, Inc., Rockford, Mich.

[21] Appl. No.: 339,198

[22] Filed: Apr. 14, 1989

[51] Int. Cl.[5] ..... A43B 13/18; A43B 19/00

[52] U.S. Cl. ..... 36/29; 36/28; 36/71; 128/594

[58] Field of Search ..... 36/71, 29, 28, 37, 35 R, 36/35 B; 128/594

[56] References Cited

U.S. PATENT DOCUMENTS

| | | | |
|---|---|---|---|
| 508,034 | 11/1893 | Moore | 36/29 |
| 586,155 | 7/1897 | Bascom | 36/29 |
| 850,327 | 4/1907 | Tauber | 36/29 |
| 900,867 | 10/1908 | Miller | 36/37 |
| 1,069,001 | 7/1913 | Guy | 36/29 |
| 1,517,171 | 11/1924 | Rosenwasser | 36/43 |
| 1,605,985 | 11/1926 | Rasmussen | 128/594 |
| 2,080,499 | 5/1937 | Nathansohn | 36/29 |
| 2,177,116 | 10/1939 | Persichino | 128/594 |
| 2,532,742 | 12/1950 | Stoiner | 36/35 B |
| 2,600,239 | 6/1952 | Gilbert | 128/594 |
| 2,605,560 | 8/1952 | Gouabault | 36/29 |
| 3,765,422 | 10/1973 | Smith | 128/594 |
| 3,871,117 | 3/1975 | Richmond et al. | 36/43 |
| 4,100,686 | 7/1978 | Sgarlato | 36/29 |
| 4,211,236 | 7/1980 | Krinsky | 128/594 |
| 4,219,945 | 9/1980 | Rudy | 36/29 |
| 4,223,457 | 9/1980 | Borgeas | 36/37 |
| 4,255,202 | 3/1981 | Swan, Jr. | 36/71 |
| 4,358,902 | 11/1982 | Cole et al. | 36/28 |
| 4,446,634 | 5/1984 | Johnson et al. | 36/29 |
| 4,458,430 | 7/1984 | Peterson | 128/594 |
| 4,567,677 | 2/1986 | Zona | 36/43 |
| 4,577,417 | 3/1986 | Cole | 36/28 |
| 4,610,099 | 9/1986 | Signori | 36/29 |
| 4,744,157 | 5/1988 | Dubner | 128/594 |
| 4,768,295 | 9/1988 | Ito | 36/29 |
| 4,802,289 | 2/1989 | Gudager | 128/594 |

FOREIGN PATENT DOCUMENTS

| | | | |
|---|---|---|---|
| 352216 | 4/1922 | Fed. Rep. of Germany | 36/29 |
| 2303384 | 8/1974 | Fed. Rep. of Germany . | |
| 2460034 | 6/1976 | Fed. Rep. of Germany . | |
| 2800359 | 7/1979 | Fed. Rep. of Germany | 36/28 |
| 2050145 | 1/1981 | United Kingdom . | |

*Primary Examiner*—Steven N. Meyers

*Attorney, Agent, or Firm*—Price, Heneveld, Cooper, DeWitt & Litton

[57] ABSTRACT

A special sealed heel bladder defining a space divided into a rear heel chamber positioned in the main heel strike area and a front heel chamber. The rear heel chamber comprises about 60 percent of the total volume. The front heel chamber comprises about 40 percent of the total volume. These chambers are divided by a diagonal interior wall at an angle of 35 degrees to a transverse line or plane and having controlled flow orifice means which regulates rate of flow of a viscous liquid from the rear heel chamber to the front heel chamber upon heel strike. The chambers are filled with a mixture of viscous liquid and a gas, typically air. The volume of viscous liquid is greater than the volume of the front heel chamber and preferably is about 80 to 90 percent of the total volume. The front heel chamber has flexible resilient walls allowing limited expansion capacity caused by temporary resilient bulging of the walls, creating a return biasing force by the walls on the liquid because of a greater pressure momentarily created in the front heel chamber by flow thereinto of a greater amount of liquid than the at-rest volume of the front heel chamber. This resilient biasing force causes effective return flow of liquid back to the rear heel chamber when pressure is released from the rear heel chamber during foot roll and toeoff by the runner.

24 Claims, 3 Drawing Sheets

FLUID DYNAMIC SHOE

BACKGROUND OF THE INVENTION

This invention relates to footwear, and is particularly suitable for athletic footwear.

Over the decades, a variety of shoe structures have been devised for cushioning the impact of heel strike. Many of these include the use of gaseous and/or liquid chambers in the shoe sole. Often these are complex and costly, even to the point of being totally impractical. Exemplary of these are:

| | | |
|---|---|---|
| U.S. Moore | 508,034 | 1893 |
| U.S. Bascom | 586,155 | 1897 |
| U.S. Tauber | 850,327 | 1907 |
| U.S. Miller | 900,867 | 1908 |
| U.S. Guy | 1,069,001 | 1913 |
| U.S. Rosenwasser | 1,517,171 | 1924 |
| U.S. Rasmussen | 1,605,985 | 1926 |
| U.S. Nathanson | 2,080,499 | 1937 |
| U.S. Gouabault | 2,605,560 | 1952 |
| U S. Smith | 3,765,422 | 1973 |
| U.S. Richmond et al | 3,871,117 | 1975 |
| U.S. Sgarlato | 4,100,686 | 1978 |
| U.S. Krinsky | 4,211,236 | 1980 |
| U.S. Cole et al | 4,358,902 | 1982 |
| U.S. Johnson et al | 4,446,634 | 1984 |
| U.S. Zona | 4,567,677 | 1986 |
| G.B. Bolla | 2,050,145 | 1981 |
| DE Linde | 2,303,384 | 1974 |
| DE Cujovic | 2,460,034 | 1976 |

The prior concepts/structures for effecting cushinging typically extend over the forefoot and heel of the sole, either as one chamber extending the length of the sole, or a heel chamber and a forefoot chamber connected by passageways. The forefoot portion is normally provided to receive fluid from the heel zone and then force the fluid back to the heel zone by pressure of the forefoot during foot roll and toeoff, in preparation for the next heel strike. These structures with fluid action beneath the forefoot allow the foot to flex laterally during foot roll and toeoff, too often resulting in instability beneath the foot so as to allow excessive pronation and/or supination with consequent potential damage or injury, particularly to the ankles and knees. Moreover, such devices do not accommodate the different impact forces resulting from different speeds of an activity, e.g. running vs. jogging. Thus, while serving to lessen the problem of impact force, they introduce the problem of instability.

Recent commercial embodiments of shoes for cushioning impact include the use of a gel in the shoe soles by one manufacturer, and of a pressurized air bladder in the shoe soles by another manufacturer. Such devices do in fact effect certain impact cushioning as has been determined by testing. However, tests show that the impact absorption of such devices, though beneficial, still exhibits sharp peak impact loads considered undesirably high. Moreover, these materials, being encapsulated under pressure and confined to a finite space, are not considered effective in accommodating different impact forces from persons of different weight or running at different speeds.

Such structures act primarily like a spring such that, following the impact of the foot, the subsequent shock tends to comes back and go right back up the person's heel. Devices acting like a spring also tend to be non-accommodating to different impact loads and rates of impact. Thus, a shoe which nicely accommodates a slow gait with proper cushioning could bottom out at a faster gait, and a shoe accommodating a faster gait would tend to be too stiff at a slower gait.

SUMMARY OF THE INVENTION

This present invention attenuates impact cushioning, yet using only the portion of the footwear underlying the heel. The novel structure does not extend beneath the forefoot to result in instability in the footwear. The structure effectively attenuates impact of heel strike beginning almost immediately, extending impact over a substantially increased time period and resulting in a considerably lower peak impact load on the person's heel, foot and leg. Even though confined to the heel, the novel structure is capable of quickly returning to the preset condition ready for the next heel strike. No fluid mechanism under the forefoot is necessary or used to cause this return action. Thus the foot roll and toeoff functions remain stable.

The invention employs a special sealed heel bladder defining a space divided into a rear heel chamber positioned in the main heel strike area and a front heel chamber. The rear heel chamber comprises about 60 percent of the total volume. The front heel chamber comprises about 40 percent of the total volume. These chambers are divided by a diagonal interior wall at an angle of 35 degrees to a transverse line or plane (55 degrees to a longitudinal line or plane) and having controlled flow orifice means which regulates rate of flow of a viscous liquid from the rear heel chamber to the front heel chamber upon heel strike, accommodating persons of differing weight and differing running speeds. The chambers are filled with a mixture of viscous liquid and a gas, typically air. The volume of viscous liquid is greater than the volume of the front heel chamber. The volume of liquid is also about 80 to 90 percent of the total volume, with a gas such as air being 10 to 20 percent of the volume. The front heel chamber has flexible resilient walls allowing limited expansion capacity caused by temporary resilient bulging of the walls, creating part of a return biasing force by the walls on the liquid because of a greater pressure momentarily created in the front heel chamber by flow thereinto of a greater amount of liquid than the at-rest volume of the front heel chamber. The remainder of the return bias force is caused by compression of any air in the front chamber. The resilient biasing force causes effective return flow of liquid back to the rear heel chamber when pressure is released from the rear heel chamber during foot roll and toeoff by the runner, so that the viscous liquid is again fully available in the rear heel chamber for cushioning and attenuating the next heel strike.

DESCRIPTION OF THE PREFERRED EMBODIMENT

Figure 1:
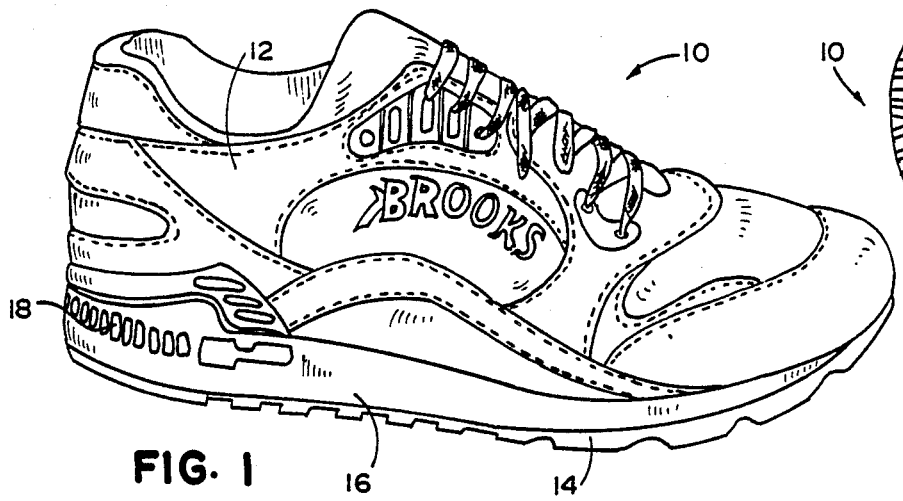
FIG. 1 is a side elevational view of a right foot shoe incorporating this invention.
Figure 2:
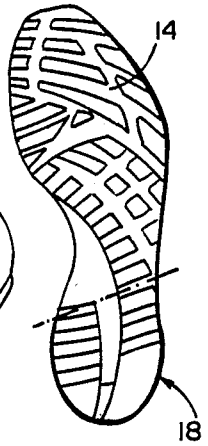
FIG. 2 is a bottom view of a left foot shoe comparable to that in FIG. 1 and showing one possible type of outer sole configuration.
Figure 3:
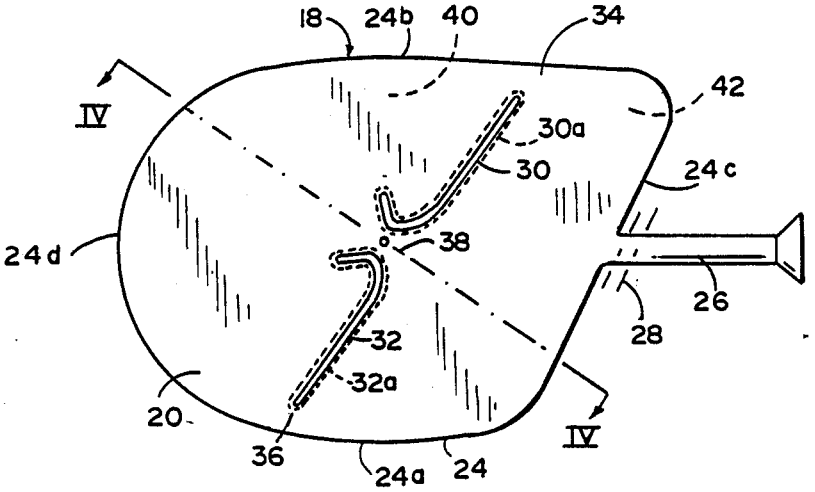
FIG. 3 is a plan view of a left foot form of the unique heel bladder insert for the midsole of this shoe.

Referring now specifically to the drawings, the shoe depicted in FIGS. 1 and 2 is shown as an athletic shoe primarily for running sport activities such as distance running, jogging and court games. The shoe employs a selected upper 12, a selected outsole 14, and a midsole 16. In the rear of the midsole is retained the special bladder structure depicted in FIGS. 3–6. The special bladder structure 18 is formed of a flexible polymeric material, preferably polyethyl vinyl acetate, or polyurethane, or the equivalent, having a wall thickness of approximately 1–2 mm and including an upper wall 20, a lower wall 22 spaced from the upper wall, and a peripheral wall 24 comprising a medial sidewall **24*a*, a lateral sidewall 24*b*, a diagonal front wall 24*c* and a convexly curved rear wall 24*d*. Front wall 24*c* is at an angle of about 25 degrees to a line transverse to the unit, with the lateral wall being longer than the medial wall. The peripheral wall is integrally joined with the upper and lower walls to form an enclosed space or chamber. Projecting from the front wall during the early formative steps of this structural component is a temporary integral filling tube 26. This enables a viscous liquid to be placed in the internal enclosed space defined by this bladder. This tube is later sealed off and severed from the finished unit at the phantom lines indicated at 28 in FIG. 3** immediately adjacent the bladder body itself. This seal/sever function can be performed by heat and pressure if the polymer is thermoplastic, or by other known alternate techniques. It has been determined that the height of the bladder body should be 10 mm at the thickest, i.e., rear end thereof. This thickness, when combined with the other features of the structure achieves what is considered the best combination of impact absorption over a range of running speeds and over a range of runner weights.

An integral interior diagonal control wall structure extends across the enclosed space. This is formed by two J-shaped, mirror image elongated vertical openings 30 and 32 through the thickness of the insert, including the upper wall and lower wall, to form adjacent wall members. This may be achieved by placing transverse J-shaped core members in the mold when forming the bladder such that a double wall **30*a* and 32*a* is formed adjacent each of these J-shaped openings 30 and 32 as indicated by the dotted lines in FIG. 3. The curved ends of these J-shaped openings are adjacent to and spaced from each other and curve convexly toward each other to form a venturi therebetween. The main straight portions of these J-shaped elements extend diagonally across the chamber, colinearly with each other, leaving an opening at the outer ends, i.e. between the outer ends of the control wall and the lateral and medial sidewalls. The walls therefore define three flow control openings 34, 36 and 38 therebetween for viscous fluid flow as explained hereinafter. The lateral side opening 34, the medial side opening 36 and the central opening 38** are each preferably 3 to 4 mm in width when employing a silicone fluid having a viscosity of about 1000 centistokes. The height of each opening is about 6½mm.

Figure 4:
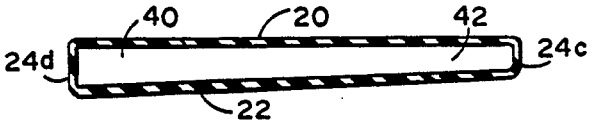
FIG. 4 is a sectional view taken on plane IV—IV of FIG. 3.
Figure 5:
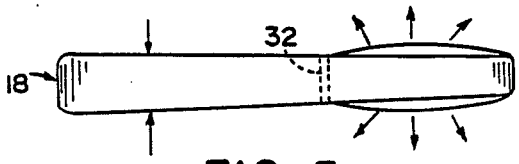
FIG. 5 is a side elevational view of the unit in FIG. 3 shown with pressure applied to the rear heel chamber as occurs during heel strike, causing the front heel chamber to bulgingly expand to a volume greater than its at-rest volume.
Figure 6:
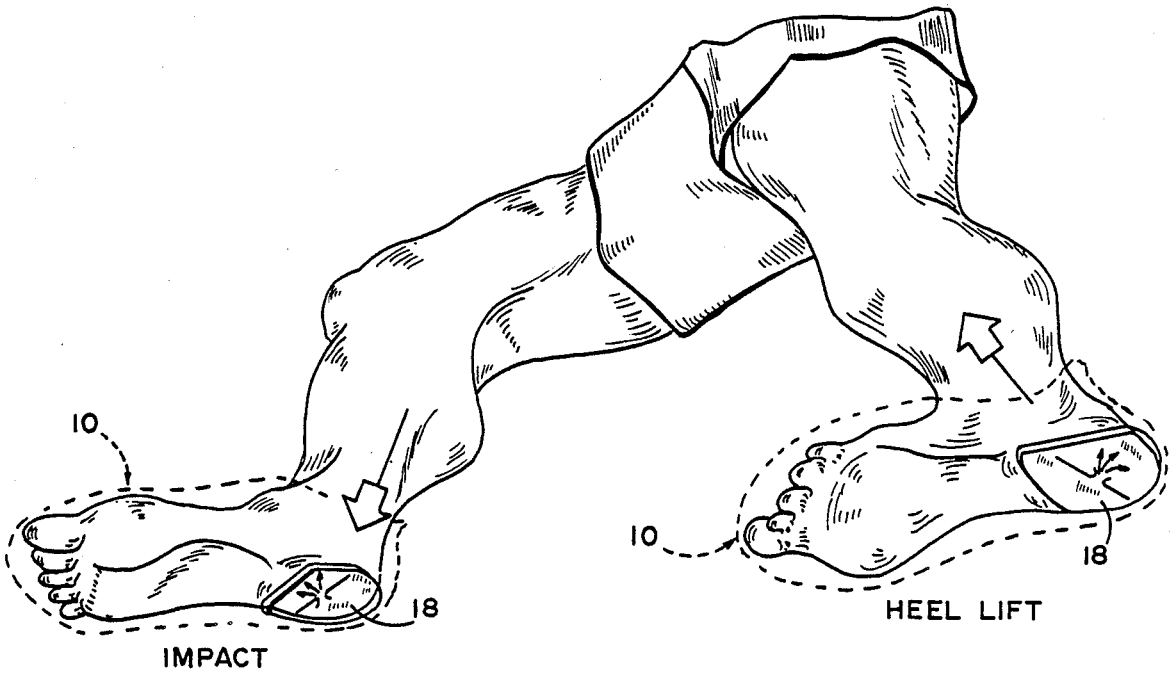
FIG. 6 is a diagrammatic perspective view of a runner whose right heel is under impact and whose left heel is lifting.

The height of the bladder tapers from rear to front, with the larger height at the rear and the smaller height at the front as illustrated most specifically in FIG. 4. In the preferred embodiment, the overall height at the rear of the bladder is 10 mm as noted above, while the front height is 7 mm. This taper in the bladder assists in enabling rapid return flow of liquid to the rear chamber, the front chamber being smaller than the rear chamber.

Intermediate these two extremities, therefore, the height is approximately 8 to 8½mm. Since the polymeric material forming the bladder is preferably approximately 1 mm thick, the height of the openings 34, 36 and 38 thus is approximately 4 to 6½mm, for an overall cross sectional area of 16 to 26 sq. mm for each passageway. Preferably the height and width of each of the three is 4 mm. The total area of the three orifices forming the passage means is about 48 to 78 sq. mm. The orifices should comprise 10 to 25 percent of the total cross sectional divider area between the front and rear chambers. If the ratio of flow opening is too large, or too small, the pad will tend to undesirably act solely like a spring.

Most runners have heel first contact. Further, runners who have heel first contact typically strike at the lateral rear corner of the heel, with a subsequent foot strike line of stress extending diagonally toward the midpoint of the heel and then longitudinally forwardly during foot roll to ultimate toeoff from the great toe.

The diagonal control wall structure separates the sealed space underlying the heel into a rear heel chamber 40 and a front heel chamber 42. The control wall extends at an angle basically normal to the foot strike line of stress experienced by most persons (basically between the dots along the left outer half of the phantom line in FIG. 3 that represents the section IV—IV). The control wall is thus at an angle of about 35 degrees to a line transverse of the heel, and about 55 degrees to a longitudinal line bisecting the heel structure.

Rear heel chamber 40 is purposely caused to be substantially larger in volume than front heel chamber 42 by location of the wall and taper of the structure. Optimally, rear heel chamber 40 comprises 60 percent of the total volume, while front heel chamber 42 comprises 40 percent of the total volume. The quantity of viscous liquid in the total space is greater than the volume of front heel chamber 42. The amount of viscous liquid is preferably sufficient to fill approximately 80 to 90 percent of the total volume, leaving 10 to 20 percent for a gas such as air. It is important to always have a significant quantity of liquid in the rear heel chamber at the time of heel impact. This is aided by having an amount of total viscous liquid greater than the volume of the front heel chamber. This is also aided by having the front or forward chamber walls resiliently flexible to bulge, such that momentarily the amount of fluid in the forward chamber is greater than the at-rest volume of the front chamber, thereby creating part of the return bias force on the liquid due to the memory of the polymer. Additional return bias force is caused by momentary compression of air in the front chamber with forced flow of the liquid into that chamber. Further, the tapered construction enables the rear chamber to have the desired greater volume as previously noted.

A shoe such as that depicted in FIG. 1 is constructed using the selected upper, the selected outsole and a midsole with a frontal portion preferably of ethylene vinyl acetate (EVA), polyurethane or the equivalent, the midsole including a peripheral portion extending around the heel to form a pocket for receiving special bladder insert 18.

This construction specially attenuates the usual sharp heel strike impact, lowering the peak load and extending the load over a significant period of time. More specifically, in a running race for example, the human foot strikes the ground with a vertical force 2.5 to 3.0 times body weight. In a 10 kilometer race, a runner weighing 175 pounds will strike the ground as many as 10,000 times, with up to 525 pounds of force at each strike. This repeated impact on the foot may cause lower extremity injuries such as shin splints, runner's knee, tendonitis and stress fractures. Studies show that approximately 80 percent of all runners strike the ground heel first, such that dampening of the heel strike can decrease the incidence of overuse injuries caused by repeated impact, and also making running more comfortable. Materials presently used for midsole construction, e.g. typically ethylene vinyl acetate (EVA), or sometimes polyurethane, do absorb impact to a certain extent.

More recently, running shoe manufacturers have attempted to solve the impact problems still remaining with EVA and polyurethane foams by using pressurized air or encapsulated gels in the midsole. Because these materials are encapsulated under pressure and confined to a finite space, these devices tend to act merely like a type of spring. Both materials are considered to have significant limitations. More specifically, compressed air under the sole of the foot can introduce instability allowing overpronation or oversupination. Moreover, it tends to result in the impact shock being returned to the foot. Gel type materials are so viscous that under pressure such become even stiffer until ultimately the vessel either ruptures or the unit bottoms out. Both types tend to accommodate only a particular weight runner and a particular running speed/impact load.

The present invention attenuates the impact of heel strike over a significant time period while lowering the peak force such that, although the impact of a fast runner typically occurs in about 20 milliseconds, the present invention attenuates the impact to decrease its peak force and extend it over a longer time period. Yet the unit returns to preset condition ready for the next heel strike. Moreover, it does this without fluid being introduced beneath the entire foot, such that instability is not introduced during foot roll and toeoff action.

Silicone fluid is employed preferably because it is temperature stable, viscosity constant and nontoxic, as well as an excellent dampener. As noted, the viscosity employed is preferably about 1000 centistokes for an orifice to wall factor in the range of 10 to 25 percent, preferably about 20 percent. The preferred range is 1000 to 1250 centistokes. Above 1250 it tends to become too viscous for optimum forward and return flow actions. Below about 800, it tends to be too fluid for normal running events of average sized person in the structure depicted. If the lower viscosity liquid is employed, the area of flow through the control wall should be decreased also, and vice versa.

The structure demonstrates a capacity to accommodate different impact forces resulting from different weights of runners and/or different speeds of running. The flow of viscous liquid is regulated by the force applied. Therefore, the same structure can be used in footwear for persons of various weight and for various type events and speeds of running.

In action, as the typical runner's heel strikes at the junction of the lateral side and the convex rear wall, and moves along the strike line of stress diagonally forwardly toward the center of the heel, the top wall of the rear chamber is flexibly depressed so that the silicone liquid is forced under pressure through the three flow control orifices to the front heel chamber in a controlled manner. Increased liquid in forward chamber 42 causes the forward chamber walls, particularly its top wall 20, to temporarily resiliently bulge as in FIG. 5, thereby creating a return pressure. As the foot strike line of stress moves to the center and then forwardly, the strike impact is attenuated, decreasing the peak force load considerably from what it would otherwise be, and extending the time period of the strike load. This occurs entirely beneath the heel. As the foot proceeds through its typical foot roll and toeoff stages, pressure is released from the rear heel chamber, pressure is momentarily applied to the top of the front heel chamber, and the bulging resilient wall of the front heel chamber applies further pressure, so that pressurized fluid in the front heel chamber flows back through the three orifices into the rear chamber, causing the unit to be prepared for the next foot strike. This return action occurs even though there is no forefoot chamber to force it back. The impact attenuation is considered markedly superior to present competitive cushioning units.

Figure 7:
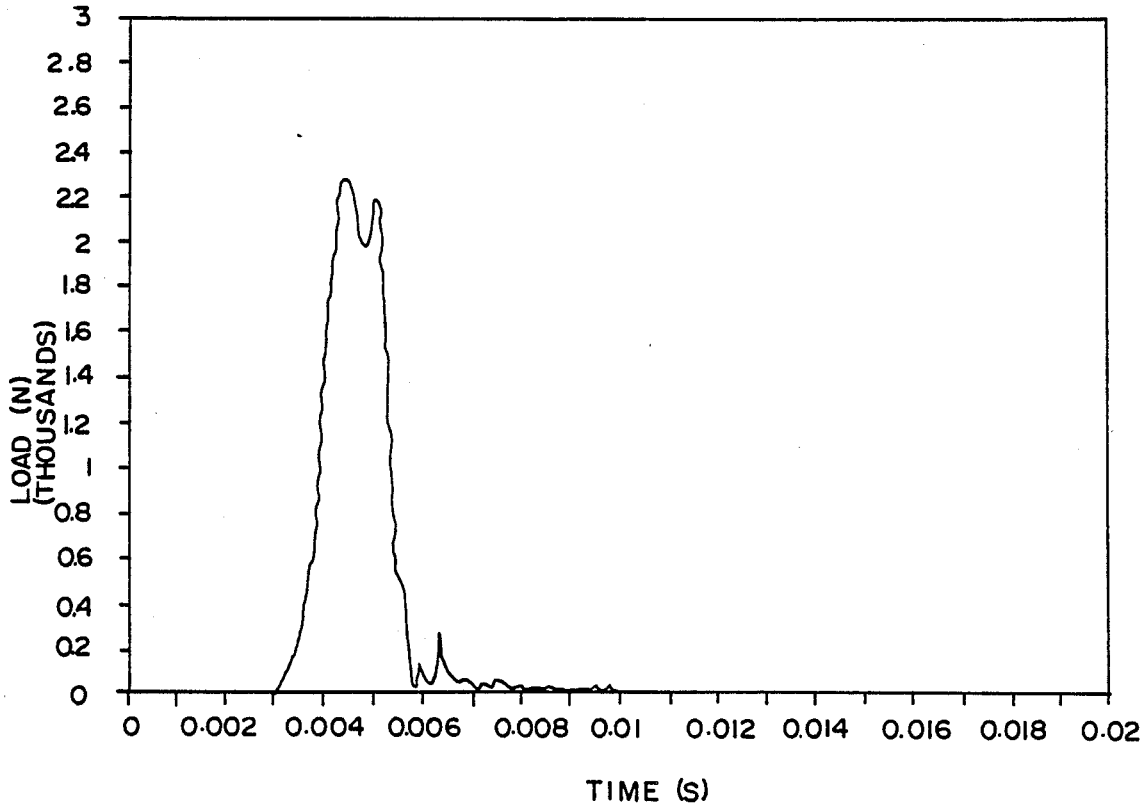
FIG. 7 PRIOR ART
FIG. 7 is a diagram of the heel impact load force pattern over a time interval, of a commercial gel-type pad for footwear presently on the market.
Figure 8:
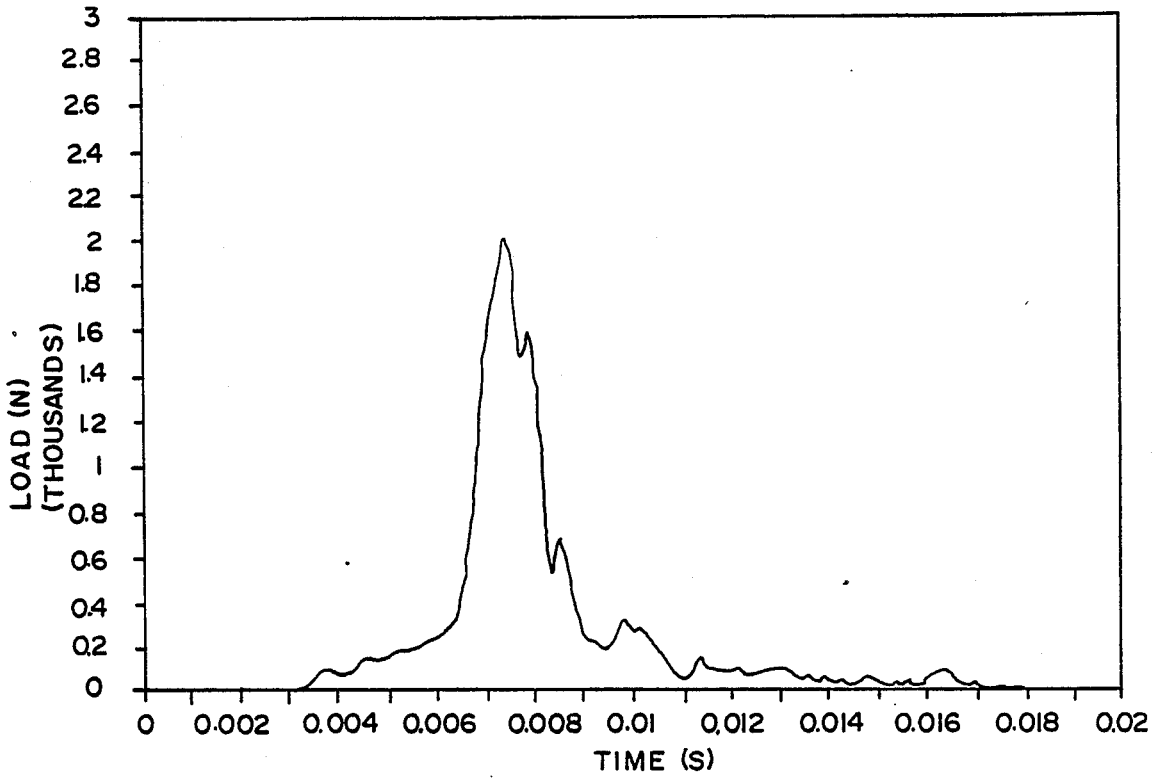
FIG. 8 PRIOR ART
FIG. 8 is a diagram of a heel impact load force pattern over a time interval, of an air type pad for footwear presently on the market.
Figure 9:
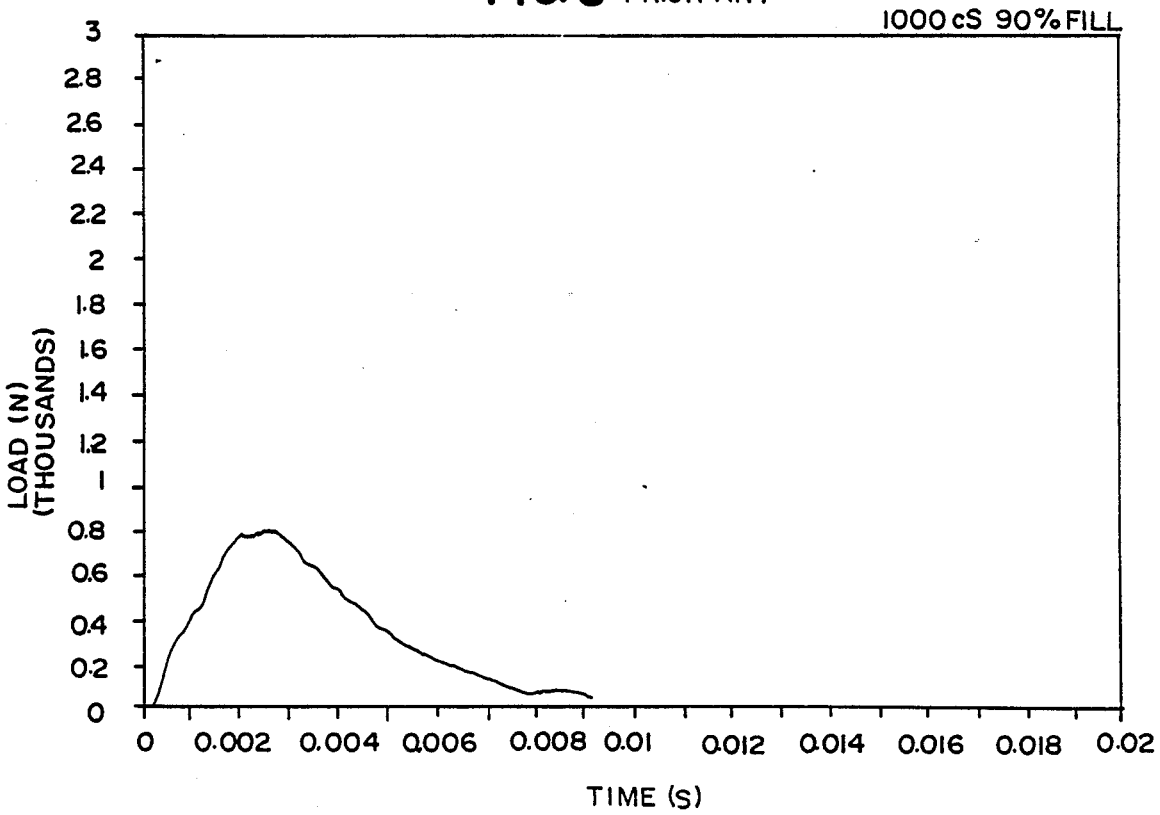
FIG. 9 is a diagram of a heel impact load force pattern over a time interval, of a heel pad of the invention herein.

FIGS. 7, 8 and 9 illustrate laboratory static impact tests on two prior inserts and the present pad. As noted, the peak load is lower and the load time is extended using the novel structure in FIGS. 3–5.

The present combination results in a dual acting response during use, with the greater effect from controlled hydrodynamic viscous flow between the rearward and forward heel chambers and a smaller spring action effect in the heel. Thus, if a runner is moving at a relatively slow pace, not only is the impact force low but also the velocity of each impact striking is slow. This results in a large bladder deflection and flow of liquid from the rear chamber to the front chamber. But, at a fast running pace, the bladder will act as a much stiffer member. This may be visualized by consideration of a bicycle pump. If small force is slowly applied to the pump, the air in the chamber readily flows in volume through the restricted outlet. But, if force is rapidly applied to the pump, sudden resistance to flow through the orifice will be experienced, with slow flow to the front chamber. Comparably, the faster paced runner applying sudden impact to the rear chamber of the novel bladder will result in substantial resistance to flow through the restricted flow area to the front chamber.

Thus, the novel pad accommodates varying speeds and different size runners. It's a stiffer cushion when running fast, and a softer cushion when running slow. Moreover, the viscous flow causes the impact shock to move to the forward chamber, rather than back to the foot.

Yet, when the foot rolls, the viscous fluid flows back to the rear chamber ready for the next impact.

It is conceivable that certain minor variations could be made in the novel structure within the scope of the concept presented. It is intended that the invention is not to be limited to the specific preferred embodiment illustrated, but only by the appended claims and the reasonably equivalent structures to those defined therein.

The embodiments of the invention in which an exclusive property or privilege is claimed are defined as follows.

1. A shock responsive heel structure for footwear comprising:

a bladder having an upper wall, a lower wall spaced from said upper wall and a peripheral wall joining said upper and lower walls, including a medial side wall and a lateral side wall connected by a front wall and merging into a curvilinear rear wall, said walls defining a sealed space therebetween;

an interior control wall between said upper and lower walls and extending diagonally generally toward said medial and lateral sidewalls, dividing said space into a front heel chamber and a rear heel chamber;

said interior control wall being transverse to a foot strike line of stress that extends from the area of merger of said lateral sidewall and said curvilinear rear wall, diagonally toward the center of said space;

a viscous liquid and ga mixture filling said chambers;

at least said upper wall being flexible to allow front heel chamber volume expansion under pressure to a volume greater than the at-rest volume thereof;

said interior control wall having restrictive gate means allowing controlled dynamic flow of said viscous liquid between said chambers for controlled flow from said rear heel chamber to said front heel chamber during initial heel strike and to also cause front chamber volume expansion for impact attenuation and cushioning during heel strike, and for return flow from said expanded front heel chamber to said rear heel chamber during foot roll.

2. The shock responsive heel structure in claim 1 wherein said interior control wall is generally normal to the foot strike line of stress.

3. The shock responsive heel structure in claim 1 wherein said interior control wall is at an angle of about 35 degrees to a transverse line bisecting said structure.

4. The shock responsive heel structure in claim 1 wherein said restrictive gate means comprises flow orifices.

5. The shock responsive heel structure in claim 4 wherein said orifices are at the center and adjacent the two ends of said interior control wall.

6. The shock responsive heel structure in claim 1 wherein said rear heel chamber has a greater volume than said front heel chamber, and said viscous liquid is greater in volume than the volume of said front heel chamber.

7. The shock responsive heel structure in claim 6 wherein said front heel chamber has a volume of about 40 percent and said rear heel chamber has a volume of about 60 percent of the combined volume of both.

8. The shock responsive heel structure in claim 1 wherein said viscous liquid and gas mixture comprises 80 to 90 percent viscous liquid and 20 to 10 percent gas.

9. The shock responsive heel structure in claim 1 wherein said restrictive gate means comprises 10 to 25 percent of the area of said control wall.

10. The shock responsive heel structure in claim 7 wherein said heel structure tapers from a greater height at the rear to a lesser height at the front thereof.

11. The shock responsive heel structure in claim 10 wherein said greater height is 10 mm.

12. The shock responsive heel structure in claim 11 wherein said lesser height is 7 mm.

13. A shock responsive heel structure for footwear comprising:

a heel bladder having an upper wall, a lower wall spaced from said upper wall and a peripheral wall joining said upper and lower walls, including a medial side wall and a lateral side wall connected by a front wall and merging into a curvilinear rear wall, said walls defining a sealed space therebetween;

an interior control wall between said upper and lower walls and extending diagonally generally between said medial and lateral sidewalls, dividing said space into a front heel chamber and a rear heel chamber;

said rear heel chamber having a volume greater than that of said front heel chamber;

said interior control wall being generally normal to the foot strike line of stress that extends from the area of merger of said lateral sidewall and said curvilinear rear wall, diagonally toward the center of said space at an angle of about 35 degrees to a longitudinal line bisecting said structure;

a viscous liquid and gas mixture filling said chambers;

said interior control wall having restrictive gate means allowing controlled dynamic flow of said viscous liquid between said chambers for controlled flow from said rear heel chamber to said front heel chamber during heel strike, and to also cause front chamber volume expansion for impact cushioning during heel strike, and for return flow from said expanded front heel chamber to said rear heel chamber during foot roll.

14. The shock responsive heel structure in claim 13 wherein said front heel chamber has a volume of about 40 percent and said rear heel chamber has a volume of about 60 percent of the combined volume of both.

15. The shock responsive heel structure in claim 13 including said upper wall being flexible to allow front heel chamber volume expansion under pressure to a volume greater than the at-rest volume thereof.

16. The shock responsive heel structure in claim 13 wherein said restrictive gate means comprises orifices at the central and end portions of said control wall.

17. The shock responsive heel structure in claim 13 wherein said rear heel chamber has a greater volume than said front heel chamber and said viscous liquid equals about 80 to 90 percent of the combined volume of both said heel chambers.

18. The shock responsive heel structure in claim 17 wherein said front heel chamber has a volume of about 40 percent and said rear heel chamber has a volume of about 60 percent of the combined volume of both.

19. The shock responsive heel structure in claim 13 wherein said restrictive gate means comprises 10 to 25 percent of the area of said control wall.

20. The shock responsive heel structure in claim 14 wherein said heel structure tapers from a greater height of 10 mm at the rear to 7 mm at the front.

21. A shock responsive heel structure for footwear comprising:

a bladder having an upper wall, a lower wall spaced from said upper wall and a peripheral wall joining said upper and lower walls, including a medial side wall and a lateral side wall connected by a front wall and merging into a curvilinear rear wall, said walls defining a sealed space therebetween;

an interior wall between said upper and lower walls and extending diagonally generally between said medial and lateral sidewalls, dividing said space into a front heel chamber and a rear heel chamber;

said interior wall being transverse to a foot strike line of stress that extends from the area of merger of said lateral sidewall and said curvilinear rear wall, diagonally toward the center of said space;

a viscous liquid and gas mixture filling said chambers;

said upper wall being flexible to allow front heel chamber volume expansion under pressure to a volume greater than the at-rest volume thereof;

said interior wall having restrictive gate means allowing controlled dynamic flow of said viscous liquid between said chambers for controlled flow from said rear heel chamber to said front heel chamber during heel strike, and to also cause front chamber volume expansion for impact cushioning during heel strike, and for return flow from said expanded front heel chamber to said rear heel chamber during foot roll;

said gate means being orifice means of a size allowing flow of a viscous liquid equal to that of flow of a silicone liquid with a viscosity of about 1000 centistokes through three orifices of about 4 mm width each.

22. The shock responsive heel structure in claim 21 wherein said viscous liquid is a silicone with a viscosity of about 1000 centistokes and said orifice means comprises 10 to 25 percent of the area of said control wall.

23. The shock responsive heel structure in claim 22 wherein said orifice means comprises three orifices, one of which is at each end of said control wall and the third is in the middle of said control wall.

24. The shock responsive heel structure in claim 23 wherein said orifices have a total flow area of about 48 to 78 sq. mm.

* * * * *